US005588196A

United States Patent [19]

Samelson

[11] Patent Number: 5,588,196

[45] Date of Patent: Dec. 31, 1996

[54] METHOD FOR MAKING A CONTAINER FROM RECYCLED PRODUCT

[76] Inventor: Judy A. Samelson, 75 Wilson's La., Needham, Mass. 02194

[21] Appl. No.: 493,891

[22] Filed: Jun. 23, 1995

Related U.S. Application Data

[62] Division of Ser. No. 154,820, Nov. 19, 1993, Pat. No. 5,464,108.

[51] Int. Cl.[6] ..... B21K 21/16

[52] U.S. Cl. ..... 29/401.1

[58] Field of Search ..... 29/401.1, 403.1; 428/903.3

[56] References Cited

U.S. PATENT DOCUMENTS

| | | | |
|---|---|---|---|
| 3,100,576 | 8/1963 | Frank | 215/382 |
| 3,244,148 | 4/1966 | Long | 215/378 |
| 3,263,847 | 8/1966 | Amann | 215/382 |
| 3,295,706 | 1/1967 | McMeekin | 215/385 |
| 3,441,002 | 4/1969 | Lawalin et al. | 229/103 |
| 3,490,501 | 1/1970 | Manem et al. | 215/382 |
| 5,314,067 | 5/1994 | Strock | 206/430 |

FOREIGN PATENT DOCUMENTS

| | | | |
|---|---|---|---|
| 903066 | 9/1945 | France | 150/118 |
| 427933 | 5/1935 | United Kingdom | 150/118 |

*Primary Examiner*—David P. Bryant

*Attorney, Agent, or Firm*—Levisohn, Lerner, Berger & Langsam

[57] ABSTRACT

A bottle is recycled into a new article of manufacture. A container for articles is thus formed. Two simple cuts are made into a bottle, the neck recycled and the base formed into a holding cavity. A fold-over flap secures the articles in the cavity. Preferably, a loop is provided on the fold-over flap to be used with a button on the base of the bottle. The device provides a secondary use for a soda bottle and is an alternative to merely crushing the same for recycling into other products.

2 Claims, 1 Drawing Sheet

FIG.1
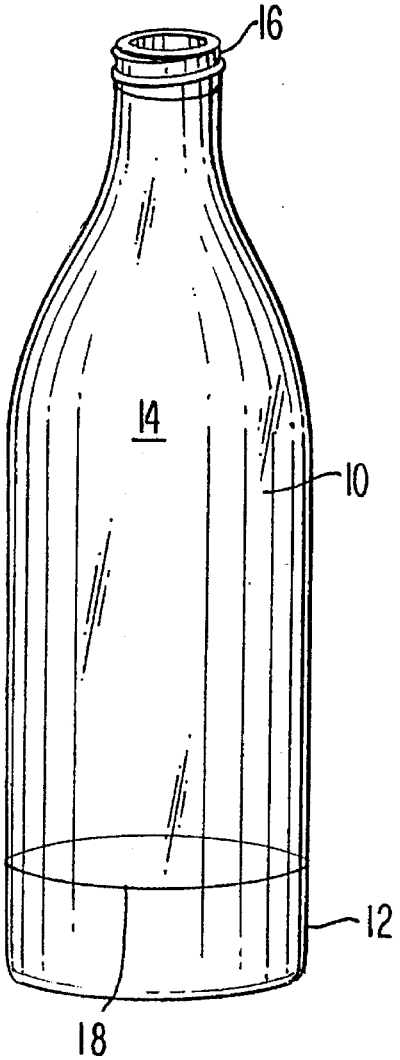
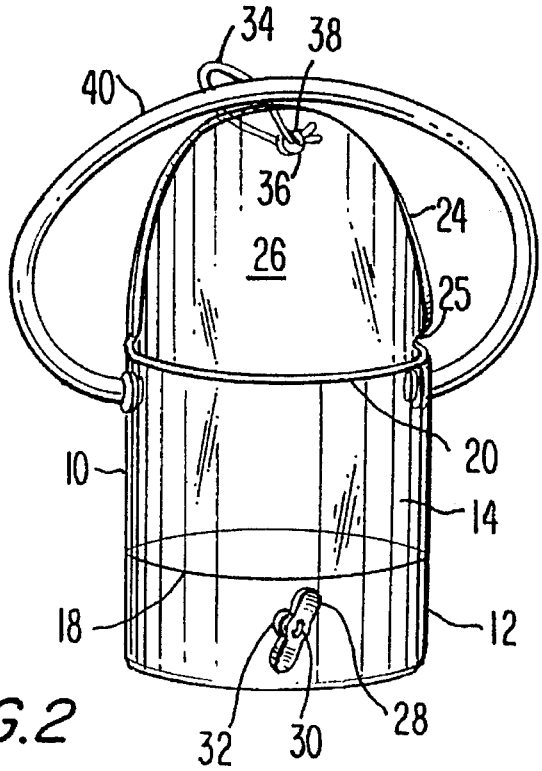
FIG.2
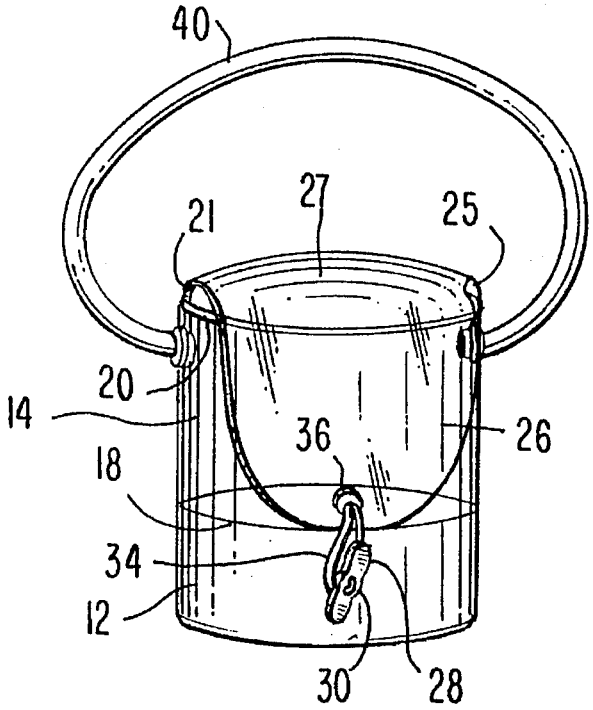
FIG.3

METHOD FOR MAKING A CONTAINER FROM RECYCLED PRODUCT

This application is a division of application Ser. No. 08/154,820, filed Nov. 19, 1993, now U.S. Pat. No. 5,464, 108, issued Nov. 7, 1995.

BACKGROUND OF THE INVENTION

The present invention relates to a container made from a recycled plastic bottle for holding articles. In the preferred embodiment of the present invention, a recyclable bottle (formerly used for containing soda, for example) is emptied of its liquid product, rinsed and cut (as explained hereinafter) to provide a holding cavity section and a closure mechanism. In the preferred embodiment, a fold-over flap is the means for closing the container. The closure mechanism serves to close the container, as desired. In addition, according to the preferred embodiment of the present invention, the container is provided with a handle or shoulder strap so that it can be easily carried. The container can serve as a purse, a pocketbook or any other container of objects. The present invention can also be used as a container for selling new articles of merchandise as, for example, scarves or jewelry or as a promotional item containing, for example, an invitation or announcement. After purchase, the purchased article can be removed and the container can be used by the purchaser as a pocketbook, or a container for other articles or other fashion accessories.

DESCRIPTION OF THE PRIOR ART

U.S. Design Pat. No. 289,451 relates to a recycled 2-liter plastic soda bottle made into a bird feeder device. More specifically, the device shown in the '451 patent is intended to be secured to the neck end of an emptied soda bottle and, in combination therewith, provides a bird feeder. Thus, the device provides a use to the soda bottle in addition to its original use as a beverage container.

Environmentally, it is highly desirable for plastics to be recycled. This is because of the unsightly damage to the environment which these materials cause if, after use, they are merely discarded. In addition, discarded plastics and other solid wastes take up space in landfills and can harm the environment by leaching toxic substances into the air and water. Many cities and towns have implemented recycling programs whereby bottles, after being emptied and rinsed, can be brought to local redemption centers or are picked up at curbside at homes for recycling. In addition, many states have implemented programs whereby consumers can take the emptied and rinsed plastic soda bottles back to the retail establishment for a few pennies per bottle. Some of these establishments provide machines into which the consumer can place the soda bottle and the machine will physically cut and crush the plastic bottle, providing the consumer with some financial return. While these efforts at collecting used plastic have met with some success, great numbers of soda bottles are still not being recycled because the monetary return is either insignificant compared to the nuisance of return or, alternatively, due to pure consumer laziness and lack of desire to fulfill one's environmental responsibilities. In addition, consumers are discouraged from recycling because there are few secondary markets for recycled plastics.

Accordingly, it is an object of the present invention to provide yet another potential use for a used soda bottle which will be additive to the recycling efforts already under way for plastic soda bottles. The inventor does not realistically contemplate that the present invention will reclaim all of the plastic currently being recycled but, rather, it is the inventor's hope that this effort be supplemental to existing recycling and reuse programs and, thereby, produce a positive benefit to the environment and, in addition, produce a useful and fashionable article from an otherwise discarded, environmentally problematic, bottle. The inventor also hopes to use this invention as an educational tool so that consumers will consider purchasing other products made from recycled plastic and manufacturers will consider using recycled plastics in place of other materials like wood, steel or concrete. The inventor plans to design a comprehensive line of containers.

Soda containers and plastic bottles have been recycled into landfill liners, insulation foam, skis, surfboards, sailboat hulls, fiber fills, carpeting, fence posts, paint brushes, strapping, certain engineering plastics, geo-textiles and non-food bottles. Based upon the information currently available to the inventor, as of 1987, about 7% of the U.S.'s total production of plastics concerns the manufacture of polyethylene terephalate (PET or PETE), a very strong and durable plastic used for soda bottles and other food containers. If recycling of this product alone were more successfully achieved, the environment would greatly benefit.

The base cup portion of 2-liter soda containers is generally made from a high density polyethylene plastic material (HDPE). This type of material, it has been estimated, comprises about 31% of plastic production of the U.S. total for the 1987 year. However, plastic is the fastest growing segment of the post-consumer waste stream because it is lightweight, versatile, and convenient, and so this number continues to increase. Thus, a 2-liter bottle of soda is generally made from two plastic components, PET or PETE and HDPE. The supplemental use provided by the present invention for the plastic soda bottle such that it will not be merely tossed aside after its original use is extremely advantageous both from an environmental perspective and, in addition, potentially, it has financial rewards to the person who can recycle the container into the useful article of merchandise.

On average, of the plastic materials collected at curbside, 50–60%, it is estimated, are PET soft drink bottles, 30–40% are HDPE milk jugs and 10–20% are mixed plastic containers. Clearly, there is a huge quantity of plastic, bottle-like containers. If a supplemental use for the plastic throw-away containers is found, then recycling efforts will be enhanced since it is believed that the more varied uses found for recyclable products, the more individuals will undertake the effort of recycling. The present invention provides a low cost, non-labor-intensive product, made from a plastic bottle. No new or expensive machinery is required.

As mentioned above, plastic recycling has increased due to bottle deposit laws and mandatory curbside recycling. On average, voluntary, drop-off programs yield a 10% recovery rate and buy-back centers yield about a 20% recovery rate. In comparison, glass and plastic bottle deposit laws yield an 80–95% recovery rate and curbside collection a 70–90% recovery rate. Again, however, providing a supplemental use for an article which, in the past, was merely tossed away, increases the desirability of recycling and, further, would tend to increase participation in recycling. If other products like the present invention are designed which enable a useful device to be made from a used bottle, they would provide a demand for such once-used bottles and, therefore, recycling would be even more economical and desirable.

SUMMARY OF THE INVENTION

The present invention relates to a supplemental or secondary use for a plastic bottle. A new bottle, after use, is emptied and rinsed. Precise cuts and folds are made into the side wall of the bottle to create a container for articles. The container can be used, for example and not by way of limitation, as a package for sale of small items or, alternatively, the container can be the new article of merchandise. The device functions as a container for small articles and can be used as a purse. Alternatively, as mentioned, the container can be used to present for sale, new articles as, for example, stockings, scarves, candy, marbles, etc. or as a promotional item.

According to the present invention, the bottle is first emptied of its contents. Then the bottle is rinsed, washed and dried. The bottle is then cut along two lines, namely, one horizontal semi-circumferential line m form the mouth of the container and a second cut, preferably in an arc, substantially in the direction of the longitudinal axis of the cylindrical bottle. A closing mechanism is provided. Preferably, a fold-over flap is formed. The flap is folded over the base of the bottle and they cooperate to form a closure mechanism for the container.

The flap is preferably provided with a closing mechanism, one form, for example, being a knob and a loop. Grommets pass through the flap and the base of the bottle to secure the knob and loop. The loop of the flap and the knob of the base mechanically cooperate to form a closure mechanism. It is a further aspect of the present invention to provide a handle or a shoulder strap to facilitate carrying of the container. The handle basically comprises a thin tube of plastic, rubber, leather, piping, etc. readily available, which preferably, passes through a pair of grommets through the side walls of the bottle. The grommets frictionally engage the tubing and produce a semi-circular handle or shoulder strap.

These and other aspects of the invention are believed taught herein and will be further described in connection with the brief and detailed description of the drawings.

BRIEF DESCRIPTION OF THE DRAWINGS

FIG. 1 is a perspective view of the one-liter plastic soda bottle currently used in connection with the manufacture and distribution of soda and other liquids.

FIG. 2 is a perspective view of the container of the present invention made from the bottom portion of the soda bottle shown in FIG. 1, with the new container shown in its open position; and FIG. 3 is a perspective view of the container of the present invention with its closing mechanism, a fold-over flap shown in its closed position.

DETAILED DESCRIPTION OF THE DRAWINGS AND THE PREFERRED EMBODIMENT OF THE PRESENT INVENTION

As seen in the figures, a one-liter plastic soda bottle is used to create a new article of merchandise. Of course, other size plastic bottles can be used and are considered within the scope of the invention, as are plastic containers of other shapes and sizes and bottles which hold liquids other than soda. However, for purposes of best illustrating the present invention, a one-liter plastic soda bottle is employed. Initially, these bottles are purchased at retail outlets. They are originally filled with liquid and very large quantities of these bottles are sold containing soda. After the fluid contents have been emptied, the consumer had several options for disposal. One of the options is throwing the bottle away. Accordingly, it is now a significant component of the environmental protection program underway in this country for plastic bottles to be recycled and re-used. Consumers return the bottles to a retail outlet, whereupon a sum of money is provided to the consumer and the retailer returns the same for further recycling to its supplier or, alternatively, the consumer can take the bottle directly to a machine which crushes the bottle in return for money. The consumer also has the option of using a sidewalk recycling program. The crushed plastic, independent of how the used bottles get to that stage, is then reclaimed by a manufacturer who cleans, rinses, shreds and melts down the plastic resin, reforming it into a new product.

It is an object of the present invention, however, to provide a secondary life or supplemental use for the emptied soda bottles which does not require new or expensive machinery. Rather, the bottles, as altered herein, produce a useful article of manufacture. The consumer or manufacturer can take the used bottles, empty, rinse and wash the same and, consistent with the teachings herein, create a new article of manufacture, namely, a container. The consumer can create the present invention from the bottle since the steps to transform the bottle into the new article of manufacture are relatively easy to accomplish and do not require artistic ability nor expensive machinery. Alternatively, a manufacturer can do the same whereupon the "converted" bottles, i.e., the containers for small articles, can be an article for sale suitable for use for storing articles. The article can be a purse or, alternatively, the container can be utilized as a package for other articles for sale as, for example, a scarf or jewelry. In this latter form, the consumer also obtains by purchase, the stored article and, a package or container which is usable, separate and apart from the contained article.

A soda bottle 10 is shown in FIG. 1. It is of the standard 1-liter variety. It comprises a base 12, traditionally now made from a different and harder plastic material in comparison to the cylindrical side wall 14 of the 1-liter bottle. The neck 16 of the bottle 10 provided with male screw threads which cooperate with the screw-on cap (not shown) of the original soda bottle container. After emptying of the liquid, the screw cap is recycled and the soda bottle has the form shown in FIG. 1. The consumer or container manufacturer will take the used soda bottle, rinse the same with soap and warm water and allow it to dry. Then, using a cutting edge, the screw threads and neck 16 are cut away and recycled, along with a portion of the front of the side wall 14. To do this, a first cut will be located at a point just a few inches (2"–6") above the top edge 18 of the base 12. This cut is made horizontally and connects the end points of a diameter of the bottle. The cut 20 extends in a horizontal plane of the soda bottle 10 and is parallel to the top edge 18 of the base 12. A second cut is then made. This cut extends in an arc, substantially along the rear and sides of the side wall 14. The second cut 24 defines an edge. Second cut 24 terminates at the ends 21 and 25 of the first cut 20.

The second cut 24 proceeds along the side wall 14 of the soda bottle 10 in a direction toward the neck 16, proceeding substantially in the direction of the vertical axis of the soda bottle and extending between the diameter end-points 21 and 25. Of course, other configurations can be used when connecting the two ends 21 and 25. The purpose to be achieved by connecting the end points by the second cut is to form a flap 26 in the side wall 14. A flap 26, the closing mechanism in the preferred embodiment, serves to close off the cavity of the container. The device thus serves as a container for articles.

As best seen in FIG. 2, horizontal cut 20 extends between the end points 21 and 25. Second cut 24 extends upwardly along the side wall 14 of the bottle and also terminates at end points 21 and 25. In an alternate embodiment of the present invention, the end points 21 and 25 are circular or curved cut-outs. This configuration, it has been found, allows for more repeated folding out of the flap 26 along bend line 27 without the bottle breaking by repeated use. The curved cut-outs reduce the tendency for propagation of the cut lines beyond that originally made. More specifically, if the opposed end points 21 and 25 end in a sharp corner then, upon repeated use of the closure by bending along 27, the end of cut 20 may propagate and create a longer cut line or result in breakage of the side wall of the bottle. It has been found however, that if the ends of the cut lines are circular or curved lines, then the ability of cut line 20 or 24 to propagate is significantly diminished.

The base 12 of the bottle 10 is provided with a button or knob 28. Preferably, the button or knob 28 is secured to the base by an elastic thread 30 passing through holes of the knob. The thread is secured to the base of the bottle by a rubber-like grommet 32. The elastic thread allows the knob easily to be hand manipulated. The fold-over flap 26 is provided with a loop 34 which, according to the preferred embodiment of the present invention, is also an elastic thread. When stretched, it is capable of being secured over the knob or button 28. This will secure the fold-over flap 26 in its closed position (See FIG. 3). Preferably, the loop 34 passes through the flap 26 and is secured there through a knot 38. A hole in a grommet 36 of the fold-over flap secures the loop 34 on one side of the flap and the knot 38 on the other side. In use, the loop 34 allows the container to be easily opened and closed, since the elasticity of the loop allows it to be easily placed over the button or knob 28. The elasticity also allows the loop to be removed from the button or knob when the container is desirably opened so as to provide access to its contents. (See FIG. 2).

In the preferred embodiment of the present invention, a holding handle 40 is provided to the container. Preferably, the handle comprises a clear, hollow tube of plastic of suitable length. The length should be sufficient so that a user's hand can be placed around the handle without contacting the fold-over flap. Each end of the handle 40 is secured through the side wall 14 of the bottle 10, just below the horizontal cut 20, adjacent to end points 21 and 25. The handle or shoulder strap, of course, provides increased utility to the container, in that it can function as a purse.

While this invention has been described with reference to specific embodiments thereof, it should be understood by those skilled in this art that various changes may be made and equivalents may be substituted without departing from the true spirit and scope of this invention. All such modifications are intended to be within the scope of the claims appended hereto.

I claim as follows:

1. A method of recycling a plastic, substantially cylindrical, conventional, soda bottle having an upwardly extending and gradually inwardly sloping neck extending from the cylindrical holding section, into a container for articles comprising the steps of:

a. cutting the cylindrical side wall of said bottle with a first horizontal cut extending between points on a diameter of the side wall of said bottle;

b. making a second cut in an arc extending between said points on said same diameter toward the neck of said bottle, and c. removing said neck end from said cylindrical holding section, said holding section thereby forming a holding cavity and a closing mechanism, at least a portion of said remaining portion of said side wall defining a fold-over flap, hinged about said points on said diameter, said first cut and said second cut extending between said diameter points in the side wall of said bottle.

2. A method as claimed in claim 1 further comprising the step of adding a handle to said container.

* * * * *